US006155859A

United States Patent [19]

Choy

[11] Patent Number: 6,155,859

[45] Date of Patent: Dec. 5, 2000

[54] IC SOCKET HAVING PRESSURE COVER AND ASSOCIATED STOPPER

[75] Inventor: Conrad Choy, San Fransisco, Calif.

[73] Assignee: Enplas Corporation, Saitama-ken, Japan

[21] Appl. No.: 09/255,027

[22] Filed: Feb. 22, 1999

[30] Foreign Application Priority Data

Feb. 27, 1998 [JP] Japan ..... 10-064000

[51] Int. Cl.[7] ..... H01R 13/62

[52] U.S. Cl. ..... 439/331; 439/73

[58] Field of Search ..... 439/331, 73

[56] References Cited

U.S. PATENT DOCUMENTS

| | | | |
|---|---|---|---|
| 4,402,563 | 9/1983 | Sinclair | 439/73 |
| 5,326,271 | 7/1994 | Kishi et al. | 439/72 |
| 5,387,120 | 2/1995 | Marks et al. | 439/331 |
| 5,609,497 | 3/1997 | Kawabe | 439/331 |
| 5,647,756 | 7/1997 | Twigg et al. | 439/331 |
| 5,807,104 | 9/1998 | Ikeya et al. | 439/73 |
| 5,807,118 | 9/1998 | Tsubota | 439/73 |
| 5,882,221 | 3/1999 | Nguyen et al. | 439/331 |

*Primary Examiner*—Neil Abrams
*Assistant Examiner*—Hae Moon Hyeon
*Attorney, Agent, or Firm*—Fish & Richardson P.C.

[57] ABSTRACT

An IC socket is provided with a pressure cover so as to be opened and closed about a rotational shaft with respect to a socket body, and when the pressure cover is closed, an IC package mounted on the socket body is pressed. In the IC socket, a stopper member is disposed to lock the pressure cover in a state that the pressure cover and the socket body are closed, a proximity member for rotating the pressure cover to the socket body side so that the pressure cover further approaches towards the socket body side from the closed state thereof. The stopper member includes a stopper piece mounted to a support shaft, which is supported to be movable in a tangential direction of a circle with the rotational shaft being the center thereof with respect to the pressure cover, and a stopper piece engaging portion formed to the socket body with which the stopper piece is engaged, and the proximity member is provided with a separation member mounted to the support shaft. A lever member is provided for the separation member in a manner such that when the lever member is operated, the separation member is rotated in one direction thereby to separate the support shaft from a surface of the pressure cover.

11 Claims, 14 Drawing Sheets

IC SOCKET HAVING PRESSURE COVER AND ASSOCIATED STOPPER

BACKGROUND OF THE INVENTION

1. Field of the Invention

The present invention relates to an IC socket for detachably holding an IC package, which is particularly provided with a mechanism for increasing a depressing force to be applicable to the IC package.

2. Prior Art

One known example of an IC socket of this type is disclosed in U.S. Pat. No. 5,120,238 such as shown in FIG. 15.

That is, with reference to FIG. 15, an IC socket is provided with a socket body 1 on which an IC package 2 is mounted so as to be electrically connected through contact pins 1*a,* and a pressure cover 3 is mounted to the socket body 1 to be rotatable about a shaft 4.

A lever member 5 is attached to a front end side (free end side with respect to the rotation) of the pressure cover to be rotatable about a shaft 6, and a stopper member 8 is also disposed at a portion apart from the shaft 6 to be rotatable about a shaft 7. The stopper member is formed with an engaging portion 8*a* which is to be engageable with a portion 1*b* of the socket body 1.

In the structure shown in FIG. 15, under the condition that the engaging portion 8*a* is engaged with the portion 1*b* of the socket body 1, when the lever member 5 is rotated in a counterclockwise direction, the shaft 7 is also rotated in the counterclockwise direction with respect to the shaft 6. As a result, because a distance between the shaft 7 and the stopper member engaging portion 8*a* does not vary, the pressure cover 3 is rotated downward, as viewed in FIG. 15, by the rotation of the lever member 5, resulting in the increasing of a pressing force to the IC package 2.

However, in the conventional structure mentioned above, the pressure cover 3 is pressed downward by utilizing the rotating motions of two shafts 6 and 7, so that the entire structure is made complicated, and moreover, when it is required to change or improve the depressing force, it will become necessary to expand the distance between both the shafts 6 and 7. Because of this reason, it is troublesome to easily change the depressing force, providing a problem.

SUMMARY OF THE INVENTION

An object of the present invention is to substantially eliminate such defects or problems as mentioned above in the prior art and to provide an IC socket having a compact structure capable of easily pressing downward a pressure cover attached to a socket body of the IC socket and easily changing a depressing force.

This and other objects can be achieved according to the present invention by providing, in one aspect, an IC socket in which a pressure cover is disposed so as to be opened and closed about a rotational shaft with respect to a socket body so that when the pressure cover is closed, an IC package mounted on the socket body is pressed downward, wherein a stopper member is disposed to lock the pressure cover in a state that the pressure cover and the socket body are closed, a proximity member for rotating the pressure cover to the socket body side so that the pressure cover further approaches towards the socket body side from the closed state thereof, the stopper member including a stopper piece mounted to a support shaft, which is supported to be movable in a tangential direction of a circle with the rotational shaft being the center thereof with respect to the pressure cover, and a stopper piece engaging portion formed to the socket body with which the stopper piece is engaged, and the proximity member being provided with a separation member mounted to the support shaft, and a lever member is provided for the separation member in a manner such that when the lever member is operated, the separation member is rotated in one direction thereby to separate the support shaft from a surface of the pressure cover.

In another aspect, there is provided an IC socket in which a pressure cover is disposed so as to be openable about a rotational shaft with respect to a socket body so that when the pressure cover is closed, an IC package mounted on the socket body is pressed, wherein a stopper member is disposed to lock the pressure cover in a state that the pressure cover and the socket body are closed, a proximity member for rotating the pressure cover to the socket body side so that the pressure cover further approaches towards the socket body side from the closed state thereof, the stopper member including a stopper piece mounted to the socket body through a stopper member support shaft, and a support shaft with which the stopper piece is engaged is provided for the pressure cover, the support shaft being movable in a tangential direction of a circle with the rotational shaft being the center thereof, and the proximity member being provided with a separation member mounted to the support shaft, a lever member is provided for the separation member in a manner such that when the lever member is operated, the separation member is rotated in one direction thereby to separate the support shaft from a surface of the pressure cover.

Furthermore, in a modified aspect, there is provided an IC socket comprising:

- a socket body provided with a plurality of contact pins;
- an IC package mounted to the socket body and provided with a plurality of terminals to be contacted to the contact pins;
- a pressure cover attached to the socket body to be rotatable so as to be opened or closed;
- a holding member mounted to an inner surface side of the pressure cover to be detachably,
- a stopper member including a stopper piece and a stopper piece engaging portion for locking the pressure cover to the socket body in a closed state;
- a proximity member supported by a support shaft provided for the pressure cover for bringing the pressure cover further close to the socket body from the closed state thereof, the proximity member including a separation member for separating the support shaft from a surface of the pressure cover; and
- a lever member for rotating the proximity member in a predetermined direction.

The above aspects may include the following preferred embodiments.

The separation member comprises a pair of cam members disposed on both sides of the rotational shaft and when the cam members are rotated in the one direction, cam surfaces of the cam members slide on the surface of the pressure cover so as to separate the support shaft from the upper surface of the pressure cover.

The separation member may be provided with a projection and when the separation member is rotated in the one direction, the projection slide on the surface of the pressure cover so as to separate the support shaft from the surface of the pressure cover.

The separation member is provided with an operation member and when the separation member is rotated in another one direction, the pressure cover is depressed so as to release an engaging state thereof by the operation member.

Furthermore, a heat sink may be provided for the pressure cover to receive a heat from the IC package through press-contact thereto, and a holding member fallout prevention member may also be provided for the pressure cover.

According to the structures and characters of the IC socket of the present invention mentioned above, it becomes possible to bring the pressure cover further close to the socket body only by rotating the separation member through the operation of the lever member mounted to the rotational shaft of the pressure cover. That is, with more simple and compact structure, as compared with the conventional structure, the pressure cover can be pressed to the socket body side.

Furthermore, when it is required to change the pressing amount, i.e. force, this requirement can be easily achieved by changing the separation member with to another one having different shape or size, thus being convenient.

Still furthermore, when the cam members as the separation member is rotated in a predetermined one direction, the cam surfaces of the cam members slide on the upper surface of the pressure cover, so that the rotating motion of the pressure cover to the socket body side can be easily and smoothly performed.

Still furthermore, the location of the operation member to the separation member makes it possible to rotate the separation member further in another one direction, whereby the pressure cover can be pressed to the socket body and the stopper member is disengaged. That is, two directional motions of the separation member can be effectively performed.

The nature and further characteristic features of the present invention will be made more clear from the following descriptions made with reference to the accompanying drawings.

BRIEF DESCRIPTION OF THE DRAWINGS

In the accompanying drawings:

FIG. 6 includes FIGS. 6A, 6B and 6C showing a cam member of the IC socket, in which

FIG. 7 includes FIGS. 7A and 7B showing a lever member of the IC socket, in which

FIG. 8 includes FIGS. 8A and 8B showing an operation of the IC socket of the present invention, in which

FIG. 13 is a view corresponding to FIG. 8 and represents a second embodiment of the present invention, in which

FIG. 14 is a view corresponding to FIG. 8 and represents a third embodiment of the present invention, in which

DESCRIPTION OF THE PREFERRED EMBODIMENTS

The IC socket according to the present invention will be described hereunder with reference to preferred embodiments shown in the accompanying drawings.

[First Embodiment]

Figure 10:
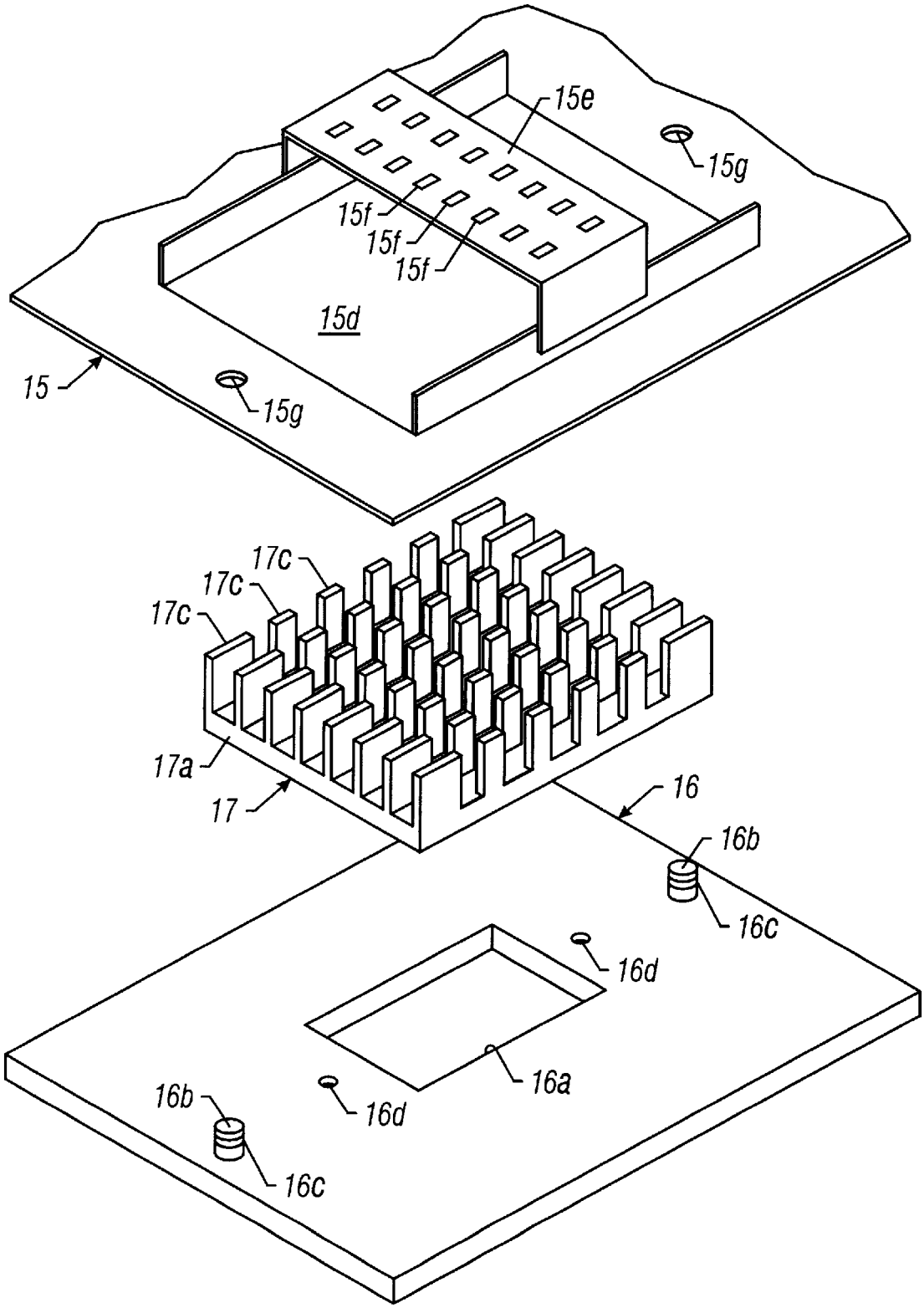
FIG. 10 is a developed perspective view of a holding member, a heat sink and a pressure cover of the IC socket of the present invention.
Figure 11:
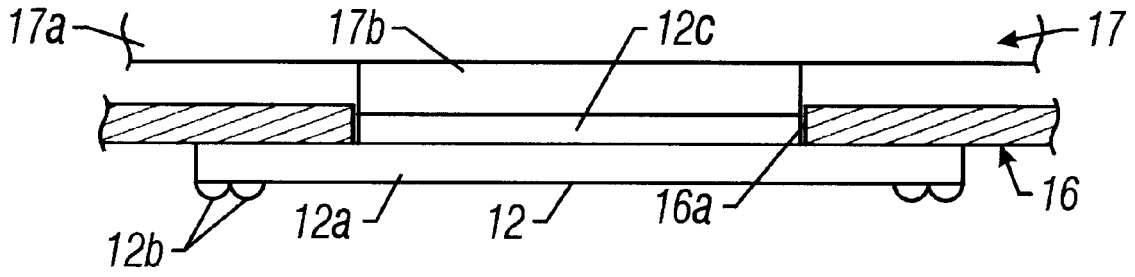
FIG. 11 is a sectional view showing a state that the holding member and the heat sink abut against the IC package.

FIGS. 1 to 12 represent a first embodiment of an IC socket of the present invention, in which the IC socket is denoted by the reference numeral 11. The IC socket 11, as shown in FIG. 11, detachably holds an IC package 12 and is adapted to electrically connect terminals 12*b* of the IC package 12 to a printed circuit board, not shown, of a tester for carrying out a performance test of the IC package 12.

The IC package 12 is provided with a package body 12*a* having a lower surface, as viewed in FIG. 11, and a number of terminals 12*b*, each in shape of ball, project downward from a peripheral portion of the lower surface. A heat radiating portion 12*c* is formed to an upper portion of the package body 12*a* so as to protrude upward.

The IC socket 11 generally comprises a socket body 13, a pressure cover 15, a holding member 16 and a heat sink 17. The IC package 12 is mounted to the socket body 13, the pressure cover 15 is rotatably mounted to the socket body 13 through a rotating shaft or pivot pin 14, and the holding member 16 attached to the pressure cover 15 so that when the pressure cover 15 is rotated downward in the state shown in FIG. 11, the IC package 12 mounted to the socket body 13 is depressed from the upper side and, then, the heat sink 17 attached to the holding member 16 abuts against the IC package 12 so as to radiate the heat of the IC package 12.

In more detail, the socket body 13 is formed with a recessed portion 13*a* having a rectangular shape, the recessed portion 13*a* has a bottom portion 13*b* to which are formed a number of through holes 13*c* into which contact pins 18 located to the socket body 13 are inserted, respectively. The contact pin 18 is formed of a material having an electrically conductive property. The contact pin 18 has an upper end portion 18*a* inserted into an insertion hole 20*a* of a floating plate 20 and secured thereto and also has an intermediate portion to which an elastically deformable spring portion 18*b* is formed. The terminals 12*b* of the IC package 12 abut against the upper end portions 18*a* of the contact pin 18, respectively.

The reference numeral 21 denotes a location board formed with insertion holes 21*a* into which lower end portions of the contact pins 18 are inserted in a state to be movable in a vertical direction.

Figure 5:
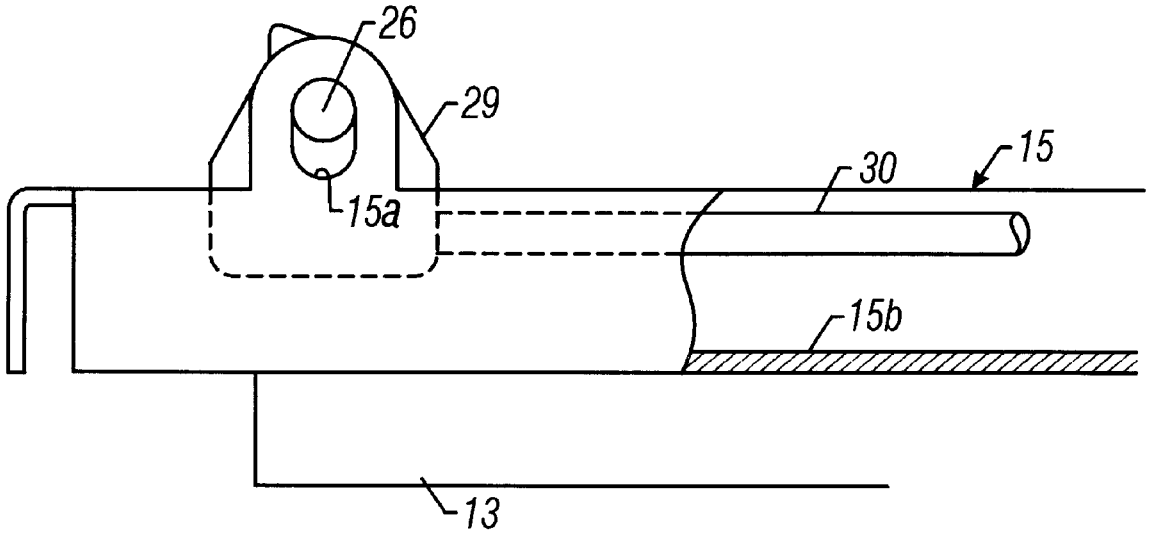
FIG. 5 is a side view showing a connecting portion of the pressure cover and a support shaft.
Figure 6A:
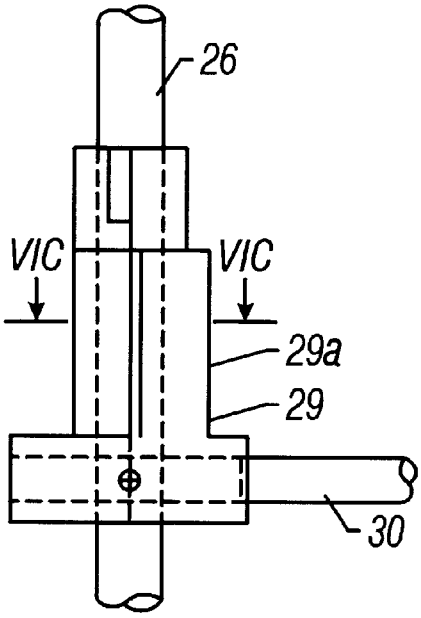
FIG. 6A is a plan view of the cam member and its associated members.
Figure 6B:
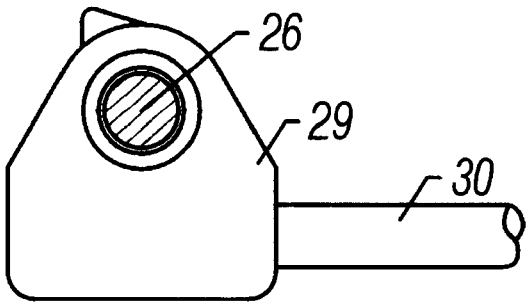
FIG. 6B is a front view of the cam member and FIG. 6C is a sectional view taken along the line VIC—VIC in FIG. 6A.
Figure 6C:
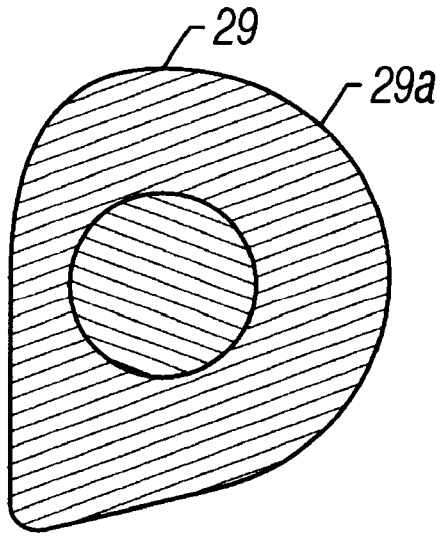
Figure 7A:
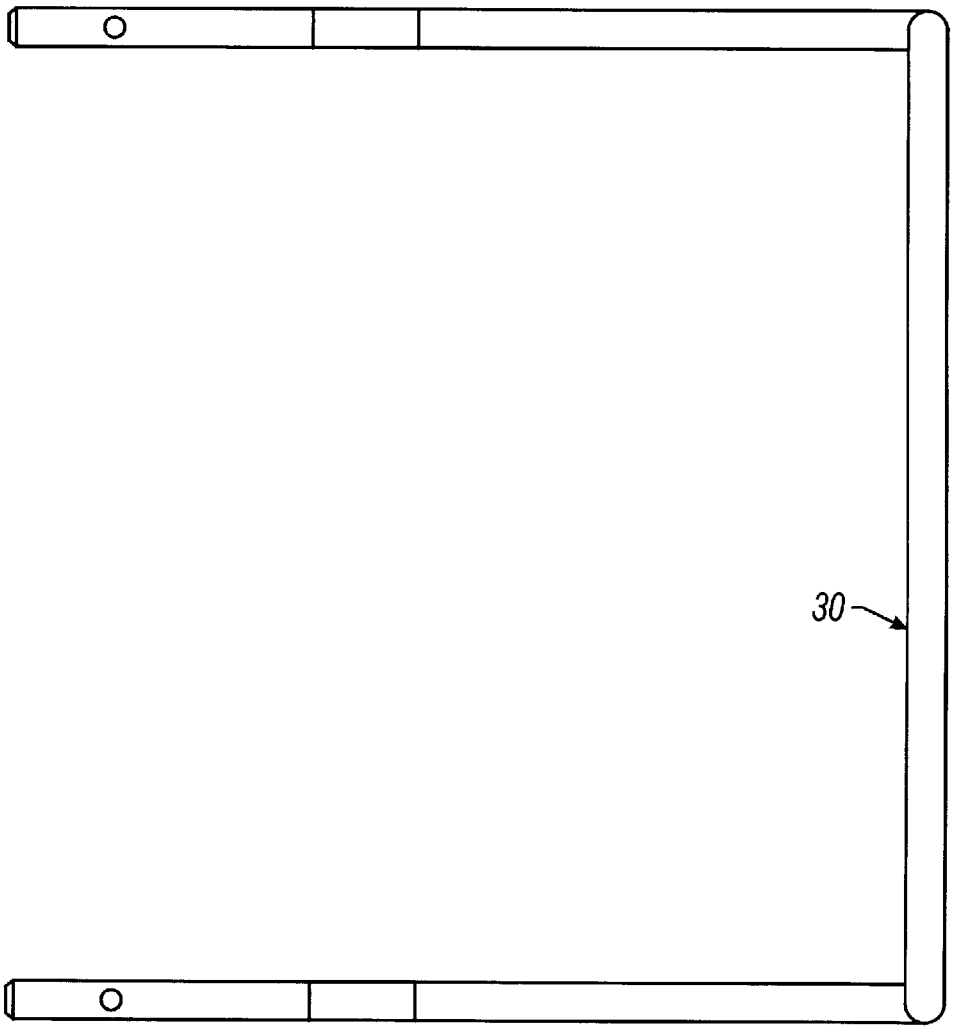
FIG. 7A is a plan view of the lever member and FIG. 7B is a front view thereof.
Figure 7B:
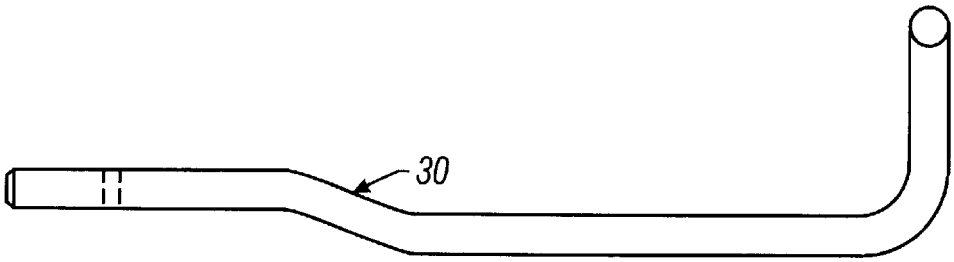

The pressure cover 15 has a base end portion rotatably mounted to the socket body 13 through the pivot pin 14 and is urged by a spring 23 in a direction for opening the cover 15. The pressure cover 15 also has a front end portion at which a stopper member 25 acting as a stopper means is supported by a support shaft or pin 26, which is idly inserted into a slot 15*a* formed to the cover 15 to be movable in a vertical direction, as shown in FIG. 5, i.e. substantially perpendicular to the circle with the pivot pin 14 being the center of the circle. The stopper member 25 is urged by a spring 27 in a counterclockwise direction in FIG. 1 to thereby be engaged with a stopper member engaging portion 13*d* formed to the socket body 13.

Figure 1:
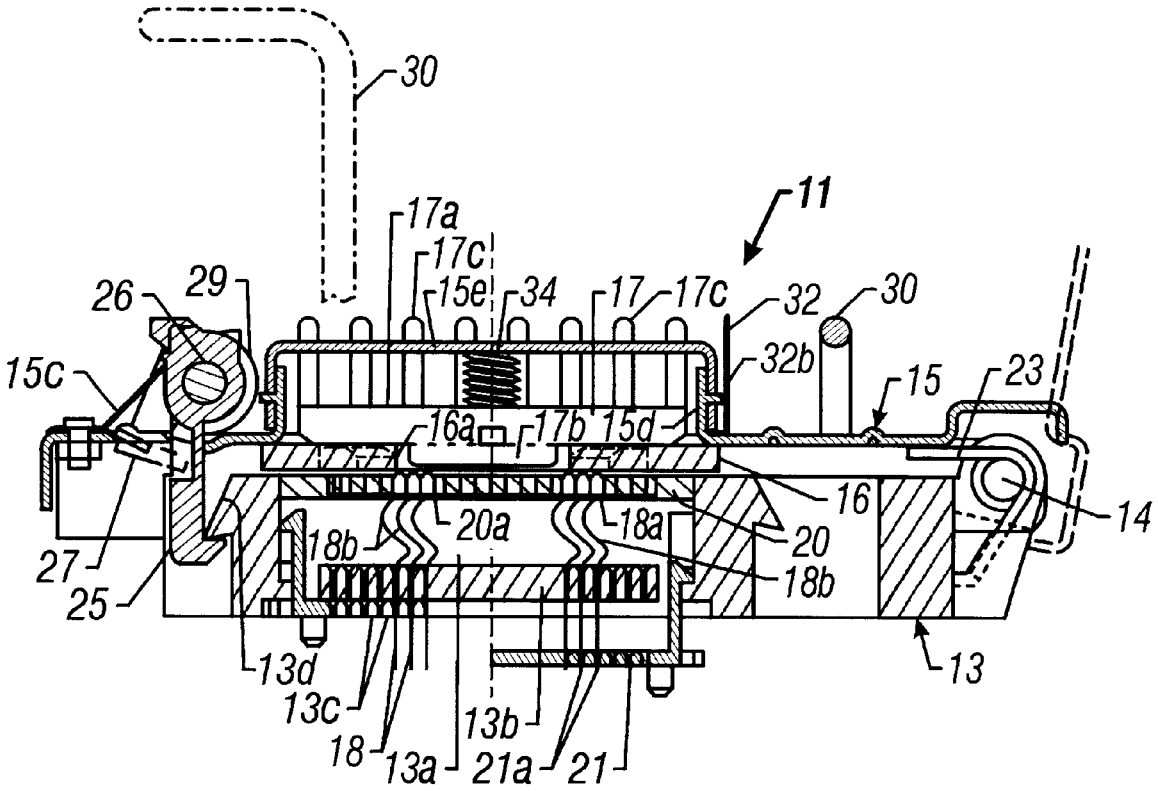
FIG. 1 is a sectional view of an IC socket according to a first embodiment of the present invention taken along the line I—I in FIG. 2, latter mentioned.
Figure 2:
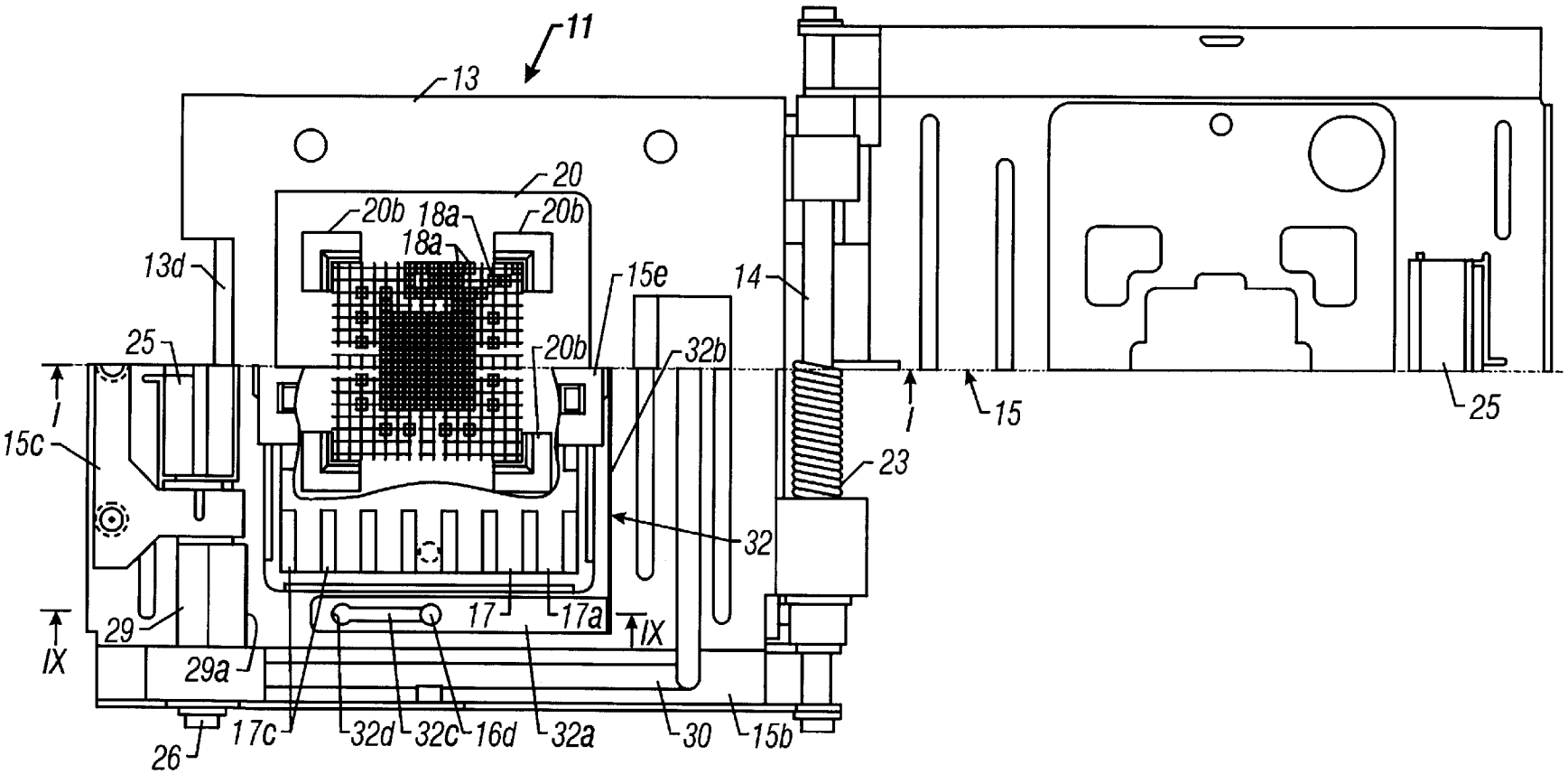
FIG. 2 is a plan view of the IC socket.

Further, as shown in FIG. 1 or 2, the support shaft 26 is always urged toward the pressure cover 15 (downward direction in FIG. 1) by a leaf spring 15*c* provided for the cover 15.

A positioning means is also disposed for further approaching the pressure cover 15 toward the socket body 13 from the engaging state mentioned above. The positioning means has a structure such that a pair of cam members 29 are disposed to be rotatable on both longitudinal ends of support shaft 26 as "separating (separation) member". Lever members 30, each having substantially a ⊐-shape, are connected to the cam members 29, respectively. The cam members 29 have cam surfaces 29*a* which contact to the upper surface of the pressure cover 15 in a slidable manner, and when the lever members 30 are rotated, the cam surfaces 29*a* slide along the upper surface of the pressure cover 15 and the pressure cover 15 therefore further approaches the side of the socket body. That is, the separation member is a member for separating the support shaft 26 from the outer surface of the pressure cover 15.

The pressure cover 15 is, as shown in FIG. 10, further formed with an opening 15*d* at substantially the central portion thereof and a heat sink receiver 15*e* (heat sink receiving recess) having substantially a ⊐-shape is formed to the opening 15*d*, the heat sink receiver 15*e* being formed with a plurality of insertion openings 15*f*.

The heat sink 17 is disposed in the heat sink receiver 15*e* in the opening 15*d* to an inner surface side on the socket body side 15. As shown in FIG. 1, for example, the heat sink 17 is provided with a plate portion 17*a*, a protruded portion 17*b* formed to the lower surface of the plate portion 17*a* so as to abut against the heat radiating portion 12*c* of the IC package 12, and a plurality of radiation projections 17*c* formed to the upper surface of the plate portion 17*a* so as to project upward. The radiation projections 17*c* are inserted into the insertion openings 15*f* formed to the heat sink receiver 15*e*, respectively.

The holding member 16 provides, as shown in FIG. 10, a rectangular plate-like shape, having a central portion at which is formed an opening 16*a* into which the protruded portion 17*b* of the heat sink 17 is inserted. A pair of pins 16*b* are formed on both sides of the opening 16*a* so as to project upward, and these pins 16*b* are inserted into through holes 15*g* formed to the pressure cover 15. Engaging grooves 16*c* are formed to the distal end portions of the pins 16 projecting over the through holes 15*g* and lock shims 32 as fallout prevention means formed on outer surface sides of the pressure cover 15 are detachably engaged with the engaging grooves 16*c*.

Figure 12A:
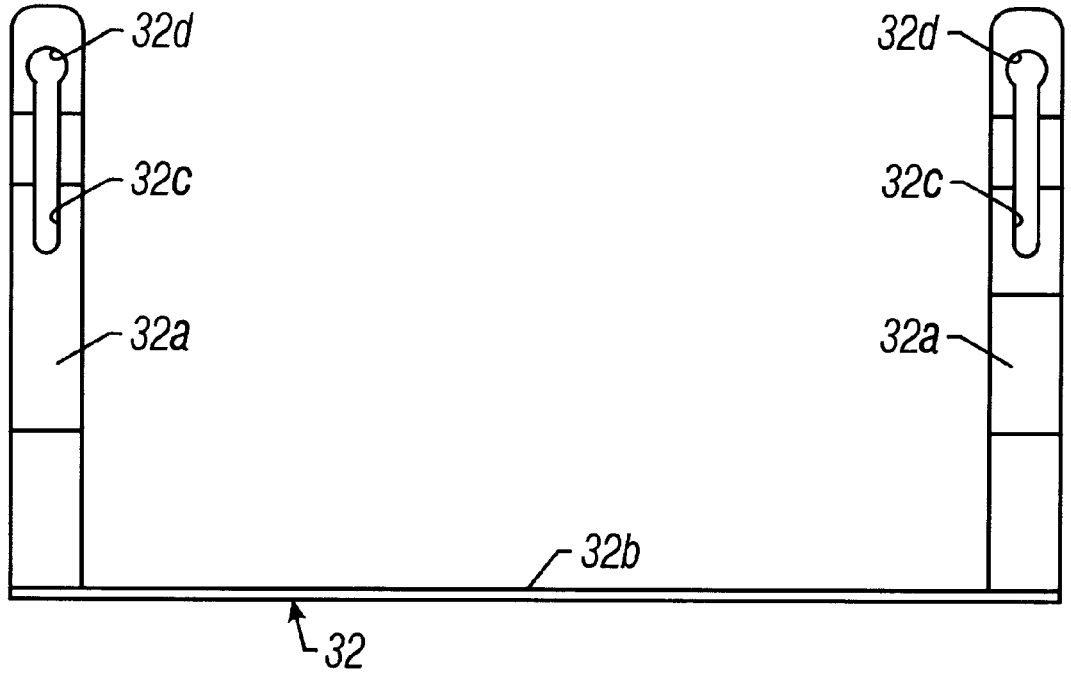
FIG. 12 includes FIGS. 12A, 12B and 12C, which are plan view, left side view and front view of a lock shim of the IC socket, respectively.
Figure 12B:
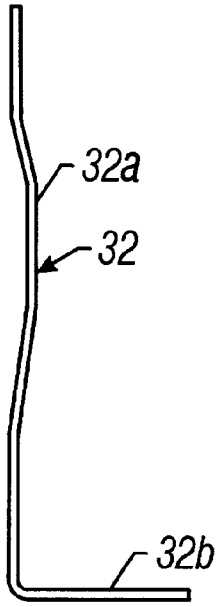
Figure 12C:
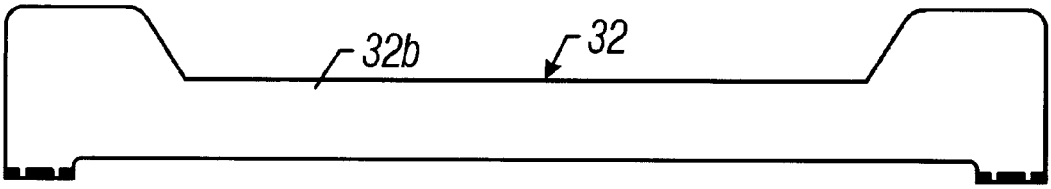

The lock shim 32 has substantially a ⊐-shaped structure, as shown in FIGS. 12A to 12C, having a pair of engaging pieces 32*a* and an operation piece 32*b* connecting the engaging pieces 32*a*, and slits 32*c* are formed to the respective engaging pieces 32*a*. Each of the slits 32*c* has a wide portion 32*d* having a size capable of inserting the pin 16*b* and has the other portion having a size smaller, narrower, than that of the wide portion 32*d*, capable of being engaged with the engaging groove 16*c* of the pin 16*b* to thereby prevent the fallout of the pin 16*b* and ensure the fixed state.

Figure 3:
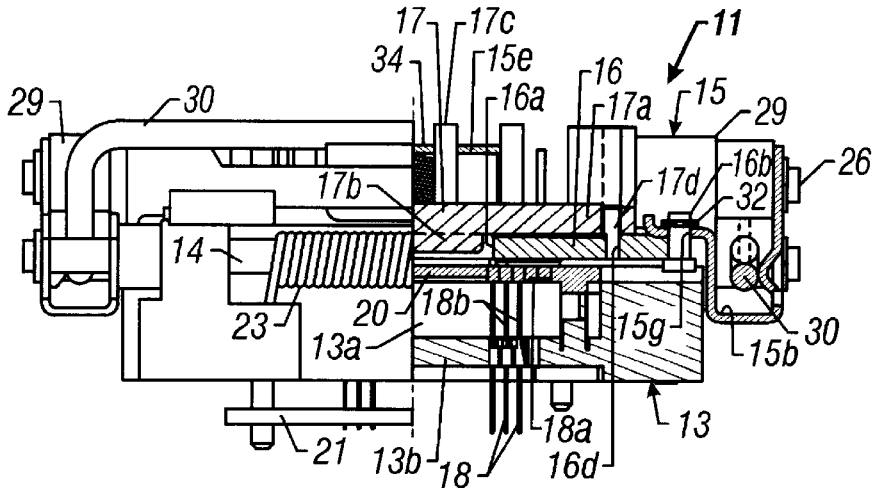
FIG. 3 is a right side view, half in section, of the IC socket.
Figure 4:
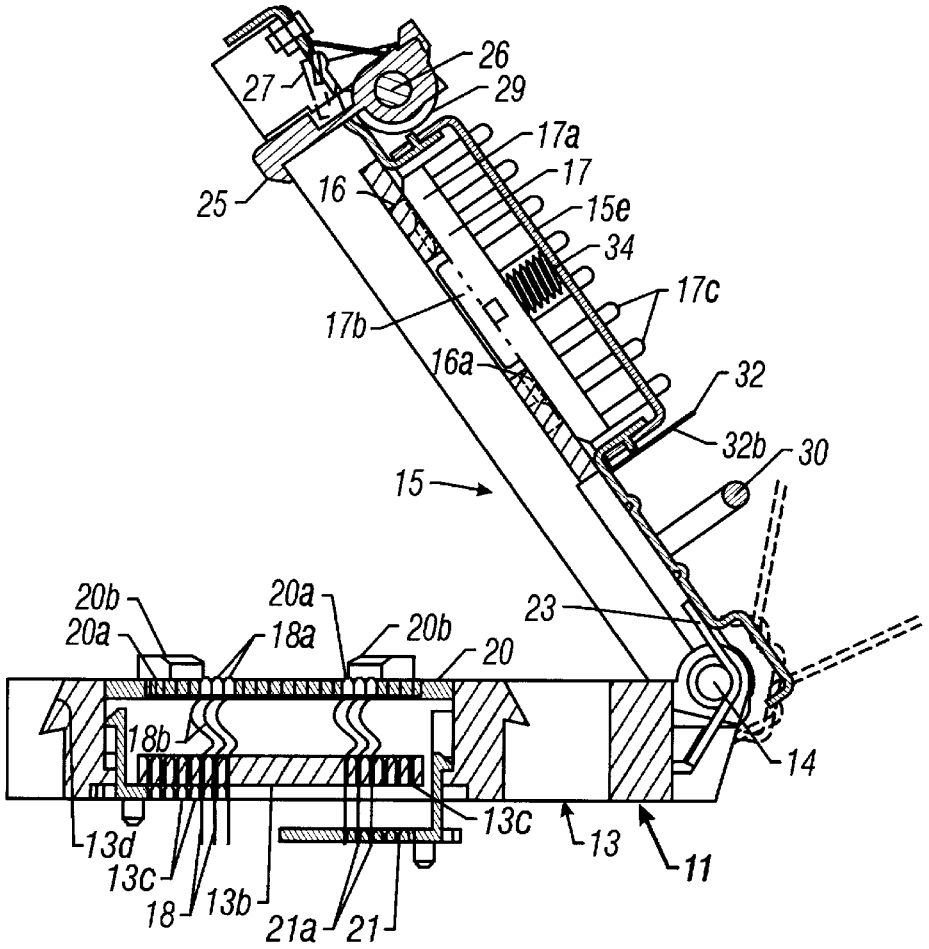
FIG. 4 is a sectional view of the IC socket with a pressure cover being opened.

Furthermore, as shown in FIG. 3, the heat sink 17 is formed with a plurality of positioning pins 17*d* so as to project downward, and the positioning pins 17*d* are fitted to engaging holes 16*d* formed to the holding member 16 to thereby establish the positioning of the heat sink 17.

Still furthermore, a coil spring 34 is disposed between the plate portion 17*a* of the heat sink 17 and the heat sink receiver 15*e* of the pressure cover 15 to urge downward the heat sink 17.

According to this structure, the heat sink 17 can be clamped between the heat sink receiver 15*e* and the holding member 16 in the detachable manner.

The IC package 12 is held by the IC socket 11 of the structure mentioned above in the following manner.

First, under the state of opening the pressure cover 15, the IC package 12 is mounted to a predetermined position on the floating plate 20 while guiding the IC package 12 by the guide projections 20*b*. Under this state, as the pressure cover 15 closes, the stopper member 25 is first engaged with the stopper member engaging portion 13*d* of the socket body 13 in a covering manner, and in this position, the lever member 30 stands upward.

Figure 8A:
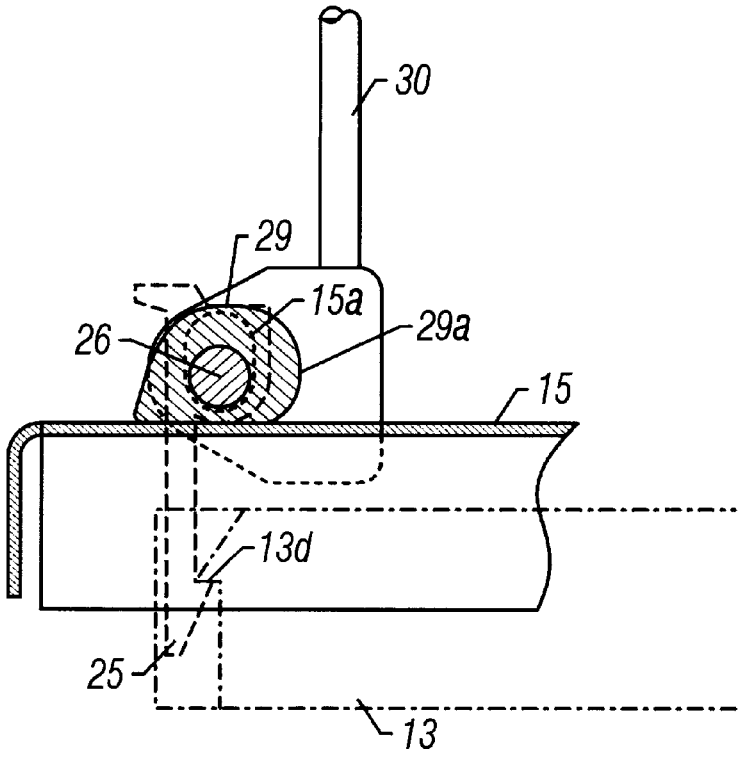
FIG. 8A is a view showing the lever member which is raised and FIG. 8B is a view showing the lever member which is brought down.
Figure 8B:
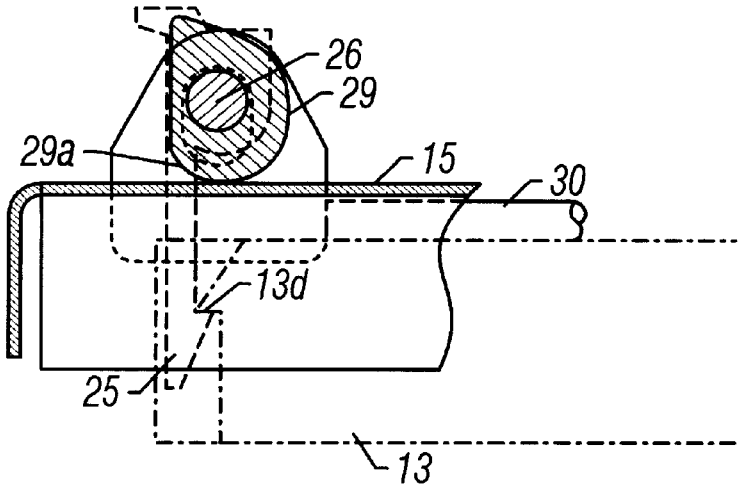
Figure 9:
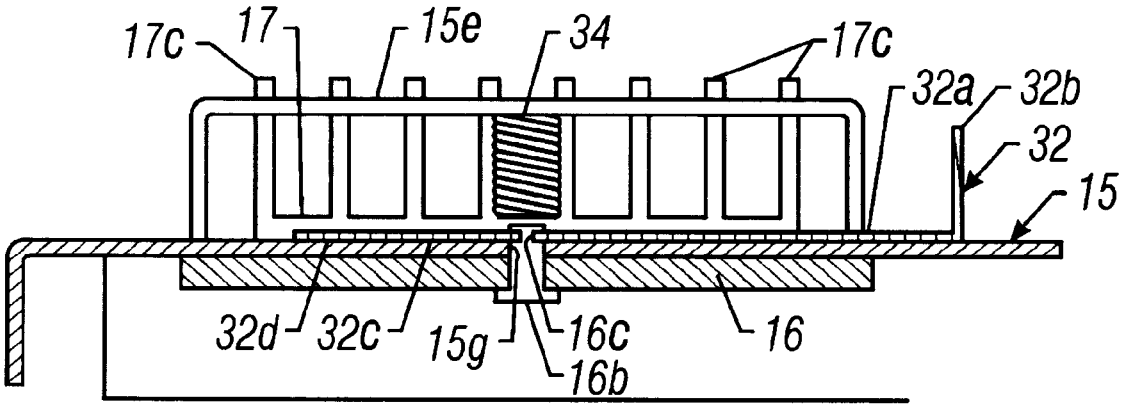
FIG. 9 is a sectional view of the IC socket of the present invention taken along the line IX—IX in FIG. 2.

Then, when the lever member 30 is rotated in the clockwise direction as shown in FIGS. 8A and 8B, the stopper member 25 is urged by the spring 27, the cam member 29 is rotated about the support pin 26 with the stopper member 25 being engaged with the engaging portion 13*d*, and the cam surface 29*a* of the cam member 29 slides on the upper surface of the pressure cover 15. Accordingly, since the stopper member 25 is engaged with the engaging portion 13*d*, the position of the support pin 26 is not changed and the support pin 26 is movable in the tangential direction of a circle with the rotational shaft 14 being the center thereof with respect to the pressure cover 15, so that the upper surface of the cover 15 is separated downward from the support pin 26, whereby the pressure cover 15 is depressed and rotated so as to approach the socket body side.

According to the operation mentioned above, the IC package body 12*a* is pressed with a predetermined force by the holding member 16 attached to the pressure cover 15, thereby bring the terminals 12*b* of the IC package 12 into contact to the upper end portions 18*a* of the contact pins 18.

In order to prevent damage of the terminals 12*b* of the IC package 12 at the time of contacting the contact pins 18, the spring portion 18*b* of the contact pin 18 has a deformable structure and when this portion 18*b* deformed at the time of contacting, the floating plate 20 is urged downward to thereby prevent an excessive contacting pressure from being applied.

Furthermore, at this contacting time, the protruded portion 17*b* of the heat sink 17 contacts, through surface-to-surface contact, the heat radiation portion 12*c* of the IC package 12 so as to release the heat of the IC package through the contact of the heat radiating projections 17*c*. Under such contacting state, the heat sink 17 is slightly deformed upward against the urging force of the coil spring 34 so as to form a gap between the heat sink 17 and the holding member 16 as shown in FIG. 11.

Further, when it is required to take out the IC package which has been held by the manner mentioned above, a manner reverse to that mentioned above may be adopted in which the lever member 30 is first rotated to its standing position to loosen the engaging condition of the stopper member 25 and the stopper member engaging portion 13*d*. In the next step, the stopper member 25 is rotated against the urging force of the spring 27 to thereby release the engaging condition thereof and then to open the pressure cover 15 by the urging force of the spring 23. In this state, the IC package 12 can be taken out.

As mentioned above, according to the structure of the present invention, the pressing force of the IC package 12 can be further improved more than in the engaging state of the stopper member 25 by utilizing a principle of lever caused by rotating the cam member 29 by means of the lever member 30. Accordingly, the contact between the terminals 12*b* of the IC package 12 and the upper end portions 18*a* of the contact pins 18 can be further ensured.

Furthermore, since the above operation can be made only by rotating the cam members 29 by means of the lever members 30, it is not necessary to employ a complicated structure or mechanism therefor as required in the prior art. Moreover, the requirement for changing the rotating amount of the pressure cover 15 will be achieved only by changing the cam member 29 now used with another one having a different shape of the cam surface 29*a*, thus being convenient.

Incidentally, when it is required to hold or mount an IC package 12 having thickness and/or size different from that of the IC package 12 now mounted, the heat sink 17 now mounted is exchanged with new one having a structure corresponding to the IC package to be newly held. That is, under the pressure cover 15 being opened, the operation piece 32*b* of the lock shim 32 will be slid in a direction of the rotating shaft 14 in FIG. 2, and then, the pins 16*b* of the holding member 16 are moved to the position of the insertion portion 32*d* of the slit 32*c* of the lock shim 32. According to this operation, the pins 16*b* of the holding member 16 can be withdrawn from the through holes 15*g* of the cover 15, thereby taking out the heat sink 17 and the holding member 16 to a portion inside (socket body 13 side) of the pressure cover 15.

The new heat sink 17 will be mounted by the manner reverse to that mentioned above.

As mentioned above, the heat sink 17 can be exchanged easily only through the attaching or detaching of the holding member 16 by detachably holding or clamping the heat sink 17 between the heat sink receiving portion 15*e* and the holding member 16.

Moreover, since the attaching and detaching operations of the holding member 16 can be done on the outer surface side of the pressure cover 15 by operating the lock shim 32, these operations can be easily and smoothly performed.

Furthermore, since the holding member 16 also attains the function of pressing the heat sink 17 and pressing the IC package 12, additional parts for attaining such function can be prevented from being further located, thus being convenient and economical.

[Second Embodiment]

Figure 13A:
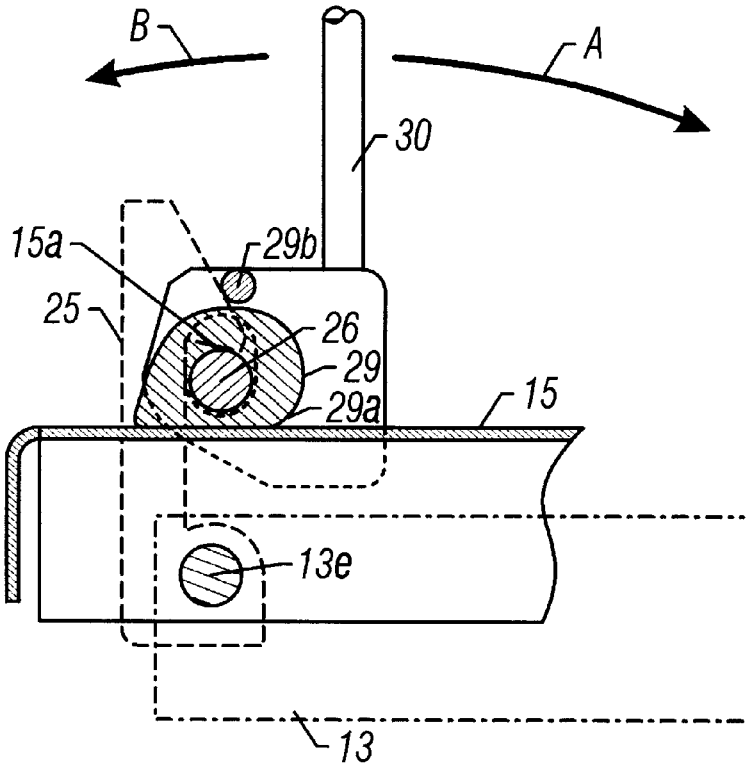
FIG. 13A is a view showing a lever member standing upward and FIG. 13B is a view showing the lever member being brought down.
Figure 13B:
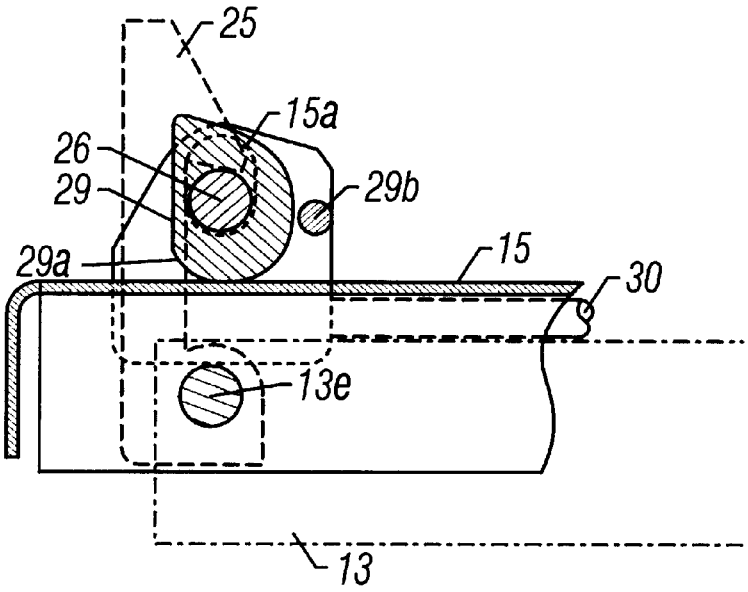

FIGS. 13A and 13B represent a second embodiment of the present invention, in which an arrangement of the stopper member 25 is different from that of the first embodiment mentioned above.

That is, in first embodiment, the stopper member 25 is mounted to be rotatable to the support shaft 26 on the pressure cover side so as to be engageable with the engaging portion 13*d* of the socket body 13. On the contrary, in this second embodiment, the stopper member 25 is mounted to be rotatable to the stopper support shaft or pin 13*e* of the socket body 13 and urged in a clockwise direction by a spring member, not shown, so as to be engageable with the support shaft 26 disposed on the pressure cover side.

According to this second embodiment, as like in the first embodiment, when the pressure cover 15 is closed, the stopper member 25 is engaged with the support shaft 26, and then, when the lever member 30 is rotated in an arrowed direction A in FIG. 13A, the cam member 29 mounted to the support shaft 26 is rotated. Accordingly, the upper surface of the pressure cover 15 is depressed by the cam surface 29*a* of the cam member 29, whereby the pressure cover 15 is further pressed towards the socket body side.

The cam member 29 is formed with an operation projection 29*b* as an operating member, and when the lever member 30 is rotated in an arrowed direction B from the state shown in FIG. 13A, the operation projection 29*b* abuts against the stopper member 25 and presses the same. Accordingly, the stopper member 25 is rotated in a counterclockwise direction in FIG. 13A or 13B, and then, the stopper member 25 is disengaged from the support shaft 26, thus the pressure cover 15 being openable.

According to the structure of the second embodiment of the present invention mentioned above, the pressure cover 15 can be opened or closed only by the hand operating of the lever member 25.

Structures and functions other than the above is substantially the same as those of the first embodiment, so that the details thereof is now omitted herein.

[Third Embodiment]

Figure 14A:
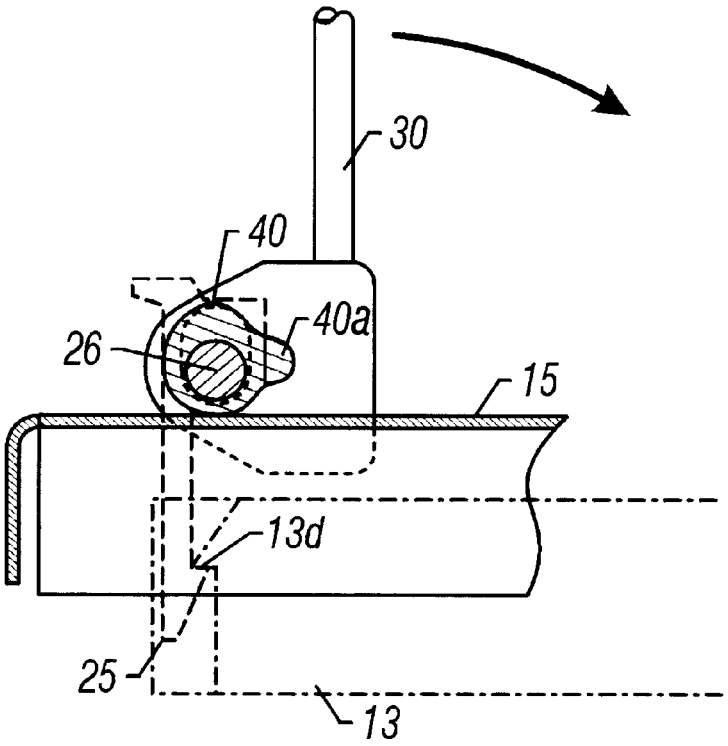
FIG. 14A is a view showing a lever member standing upward and FIG. 14B is a view showing the lever member being brought down.
Figure 14B:
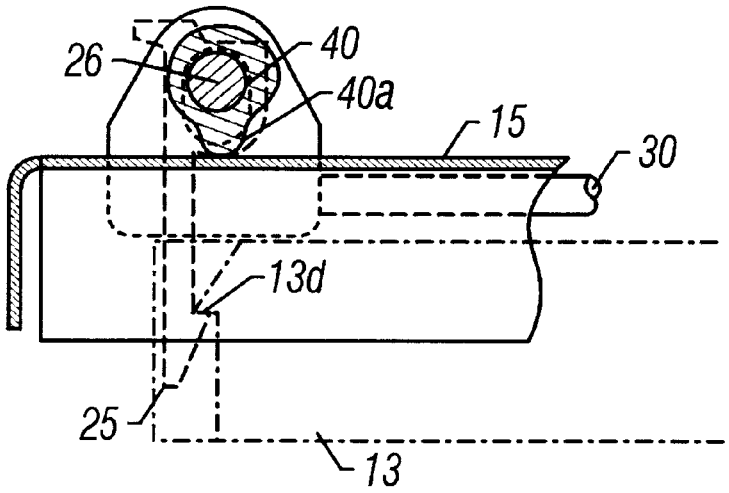
Figure 15:
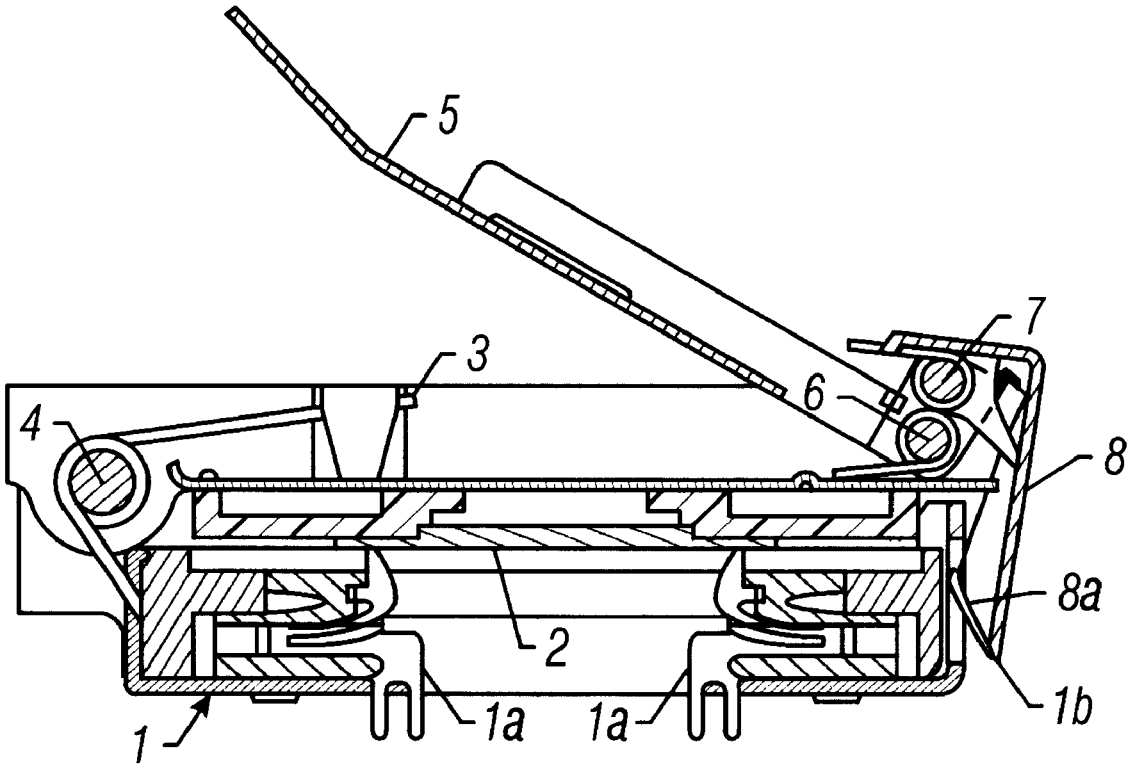
FIG. 15 (Prior Art)
FIG. 15 is a sectional view showing an IC socket having a conventional structure.

FIGS. 14A and 14*b* represent a third embodiment of the present invention, in which a location or formation of a separation member 40 differs from the first embodiment.

That is, in this third embodiment, the separation member 40 having a projection 40*a* is disposed in place of the cam member 29 having the cam surface as the separation member in the former embodiment.

According to this structure, when the separation member 40 is rotated through the operation of the cover member 30, the projection 40*a* slides on the upper surface of the pressure cover 15, whereby the pressure cover 15 is depressed by utilizing the principle of lever from the state shown in FIG. 14A to the state shown in FIG. 14B.

Structures and functions other than the above is substantially the same as those of the first embodiment, so that the details thereof is now omitted herein.

Further, it is to be noted that the present invention is not limited to the described embodiments and many other changes and modifications may be made without departing from the scope of the appended claims.

For example, the "separation member" mentioned above with reference to the various embodiments is not limited to one having the described shape and any other shapes may be adopted as far as the separation member attains the function of being rotated through the operation of the lever member, sliding on the upper surface of the pressure cover and rotating the pressure cover towards the socket body side with a small operating force by utilizing the principle of lever.

What is claimed is:

1. An IC socket comprising:

a socket body provided with a plurality of contact pins;

an IC package mounted to the socket body and provided with a plurality of terminals to be contacted to the contact pins;

a pressure cover attached to the socket body to be rotatable so as to be opened or closed;

a stopper means including a stopper member and a stopper member engaging portion for locking the pressure cover to the socket body in a closed state;

a positioning means supported by a support shaft provided for the pressure cover for bringing the pressure cover further close to the socket body from said closed state, said positioning means including a separation member for separating the support shaft from a surface of the pressure cover; and a lever member for rotating said positioning means in a predetermined direction, said separation member comprising a cam member disposed for said support shaft is rotable in one direction, said cam member having a cam surface sliding on the surface of the pressure cover through the operation of the lever member so as to separate the support shaft from said surface of the pressure cover.

2. An IC socket according to claim 1, wherein said stopper member is mounted to the support shaft to be movable in a direction substantially perpendicular to the upper surface of the pressure cover and said stopper member engaging portion is formed to said socket body with which said stopper member is engaged.

3. An IC socket according to claim 1, wherein said stopper member is mounted to the socket body through a stopper member support shaft and the support shaft to which said stopper member is engaged is provided for the pressure cover, said support shaft being movable in a direction perpendicular to the upper surface of the pressure cover.

4. An IC socket according to claim 1, wherein said cam member comprises a pair of cam sections disposed on both sides of said support shaft to be rotatable in one direction, said cam sections having cam surfaces sliding on the surface of the pressure cover through the operation of said lever member so as to separate the support shaft from said surface of the pressure cover.

5. An IC socket according to claim 1, wherein said separation member is provided with an operation member and when said separation member is rotated in another one direction, said stopper member is depressed so as to release an engaging state thereof by said operation member.

6. An IC socket according to claim 1, further comprising a holding member mounted to an inner surface side of the pressure cover to be detachably.

7. An IC socket according to claim 6 further comprising a heat sink mounted to the pressure cover so that when the pressure cover is closed, the heat sink contacts the IC package.

8. An IC socket comprising:

a socket body provided with a plurality of contact pins;

an IC package mounted to the socket body and provided with a plurality of terminals to be contacted to the contact pins;

a pressure cover attached to the socket body to be rotatable so as to be opened or closed;

a stopper means including a stopper member and a stopper member engaging portion for locking the pressure cover to the socket body in a closed state;

a positioning means supported by a support shaft provided for the pressure cover for bringing the pressure cover further close to the socket body from said closed state, said positioning means including a separation member for separating the support shaft from a surface of the pressure cover; and a lever member for rotating said positioning means in a predetermined direction, said separation member being provided with a projection and being rotated in one direction, said projection sliding on the surface of the pressure cover through the operation of said lever member so as to separate the support shaft from said surface of the pressure cover.

9. An IC socket according to claim 8, wherein said separation member is provided with an operation member and when said separation member is rotated in another one direction, said stopper member is depressed so as to release an engaging state thereof by said operation member.

10. An IC socket according to claim 9, further comprising a holding member mounted to an inner surface side of the pressure cover to be detachably.

11. An IC socket according to claim 10 further comprising a heat sink mounted to the pressure cover so that when the pressure cover is closed, the heat sink contacts the IC package.

* * * * *